United States Patent [19]

Wright

[11] Patent Number: 4,885,883

[45] Date of Patent: Dec. 12, 1989

[54] TWO-BY-FOUR CORNER MEMBERS

[76] Inventor: Robert L. Wright, 552 Glendale, Valparaiso, Ind. 46383

[21] Appl. No.: 163,187

[22] Filed: Feb. 25, 1988

Related U.S. Application Data

[63] Continuation of Ser. No. 833,991, Feb. 27, 1986, abandoned.

[51] Int. Cl.[4] ..... E04B 1/38

[52] U.S. Cl. ..... 52/280; 403/172; 403/176

[58] Field of Search ..... 52/280, 658; 403/171-176, 305

[56] References Cited

U.S. PATENT DOCUMENTS

| | | | |
|---|---|---|---|
| 1,807,186 | 5/1931 | Warner | 403/172 |
| 2,016,702 | 10/1935 | Bauer | 182/228 |
| 2,611,160 | 9/1952 | Hanesse | 403/190 |
| 2,895,186 | 7/1959 | Franks | 403/176 |
| 2,931,129 | 4/1960 | Boniface | 403/171 |
| 3,740,084 | 6/1973 | Tellberg | 403/171 |
| 4,076,431 | 3/1978 | Burvall | 403/171 |

FOREIGN PATENT DOCUMENTS

| | | | |
|---|---|---|---|
| 1162637 | 4/1958 | France | 403/305 |
| 1229153 | 3/1960 | France | 403/171 |
| 901885 | 7/1962 | United Kingdom | 403/171 |
| 910183 | 11/1962 | United Kingdom | 403/171 |

*Primary Examiner*—James L. Ridgill, Jr.

*Attorney, Agent, or Firm*—James D. Hall; Thomas J. Dodd; Todd A. Dawson

[57] ABSTRACT

Corner joiner units for connecting standard two-by-four lumber and the manner of making structures from these is depicted. The corner units are of plastic and have two horizontal sleeves for receiving horizontal two-by-fours and at least one vertical sleeve for receiving the butt end of a vertical two-by-four. The plastic unit includes internal walls and internal openings between the sleeves, so that each two-by-four received in the horizontal sleeves is in direct wood-to-wood contact with approximately half of the butt surface of the vertical two-by-four, so as to directly transfer vertical forces there between, without the joiner unit being subject to such vertical forces. Several variations of such joiner units are disclosed for different types of corners, as is a framework made from such members and two-by-fours.

1 Claim, 3 Drawing Sheets

TWO-BY-FOUR CORNER MEMBERS

This is a continuation of co-pending application Ser. No. 833,991 filed on Feb. 27, 1986 now abandoned.

FIELD OF THE INVENTION

The present invention is directed to a new and improved corner member or joiner unit and manner of forming structures from it.

BACKGROUND OF THE INVENTION

It has become conventional to use steel joiner units in construction in some applications to decrease the on-site labor and to make a secure joint using the strength of the steel unit.

It has also been suggested that frameworks for certain applications, such as boat covers, wherein the structure may be dismantled and stored, have corner-joining elements of strong metal such as steel. See, for example, U.S. Pat. No. 3,740,084, issued on June 19, 1973, to K. O. Tellberg, entitled READILY DETACHABLE SELF-ALIGNING JOINT, and U.S. Pat. No. 4,076,431, issued on Feb. 28, 1978, to S. Burvall and entitled CONNECTING ELEMENT.

Such joining elements of the above patents are formed of a series of rectangular tubular metal sleeve sections, closed at one end to form end caps and firmly secured together by welding or forging or casting in one piece. These joiner members, by design, bear the entire weight of the received members and, thus, are of necessity made of tough, strong materials.

SUMMARY OF THE INVENTION

Contrary to that prior approach, the present invention provides a corner member which need not be as strong as such prior members. The present member employs the natural strength of the wood two-by-fours to bear the vertical weight and forces on the structure.

A corner member constructed in accordance with the principles of the present invention includes three interconnected sleeves, each sized to receive standard-sized lumber such as the two-by-four commonly in use in the United States of America for construction. The sleeves are formed unitarily with one another and include at least one vertically-oriented sleeve and two horizontally-oriented sleeves. The sleeves are opened into one another but provided with a means for stopping the advance of at least one of the horizontal lumber, so that it is vertically aligned with approximately half of the vertically-received lumber member and so arranged that the butt end of the vertical lumber is in direct contact over about half of its surface, with lumber received in each of the horizontal sleeves, so that the corner member does not bear vertical forces or weight, but these are passed directly between the received horizontal lumber and the vertical lumber.

The invention, together with the advantages thereof, may best be understood by reference to the following description taken in connection with the accompanying drawings, in the several figures of which, like reference numerals identify like elements.

DETAILED DESCRIPTION OF PREFERRED EMBODIMENTS

Figure 1:
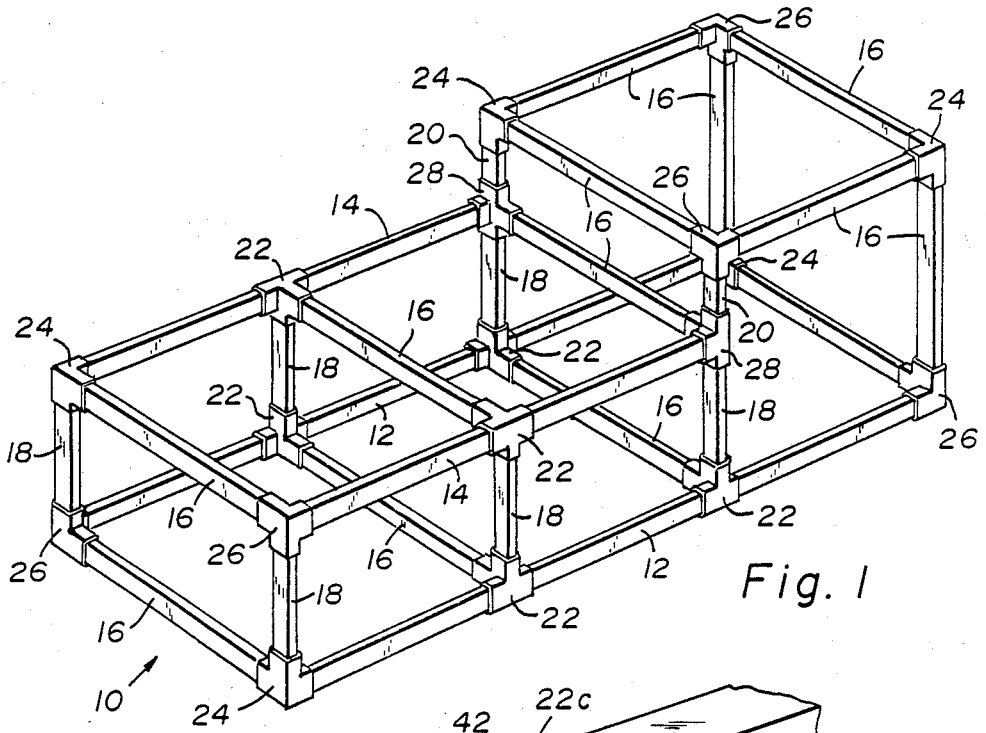
FIG. 1 is a perspective view of a framework with corner members constructed in accordance with the principles of the present invention.

Referring now to FIG. 1, there is depicted a structure generally designated by the number 10 which is constructed using the principles of the present invention. The structure 10 includes two long two-by-four timbers 12, each of which extends the length of the structure 10. It also includes two somewhat shorter two-by-four lengths 14 which extend approximately two-thirds of the length of the structure 10.

Eleven medium-length two-by-four timbers 16 (most of which extend transversely), six short two-by-four vertical timbers, 18 and two very-short-length two-by-four timbers 20 complete the triangular portion of the structure 10.

Four different types of corner units 22, 24, 26, and 28, each of which is constructed in accordance with the principles of the present invention, are provided at the corners where the two-by-four timbers meet. The particular structure 10 depicted in FIG. 1 has four corner units 22, five corner units 24, five corner units 26, and two corner units 28.

Each of the corner units 22, 24, 26, and 28 are constructed in a similar manner, and we will discuss in particular the construction of units 22, 26, and 28, it being understood that the unit 24, which is the mirror image of the unit 22, may be constructed in the same manner.

Figure 2:
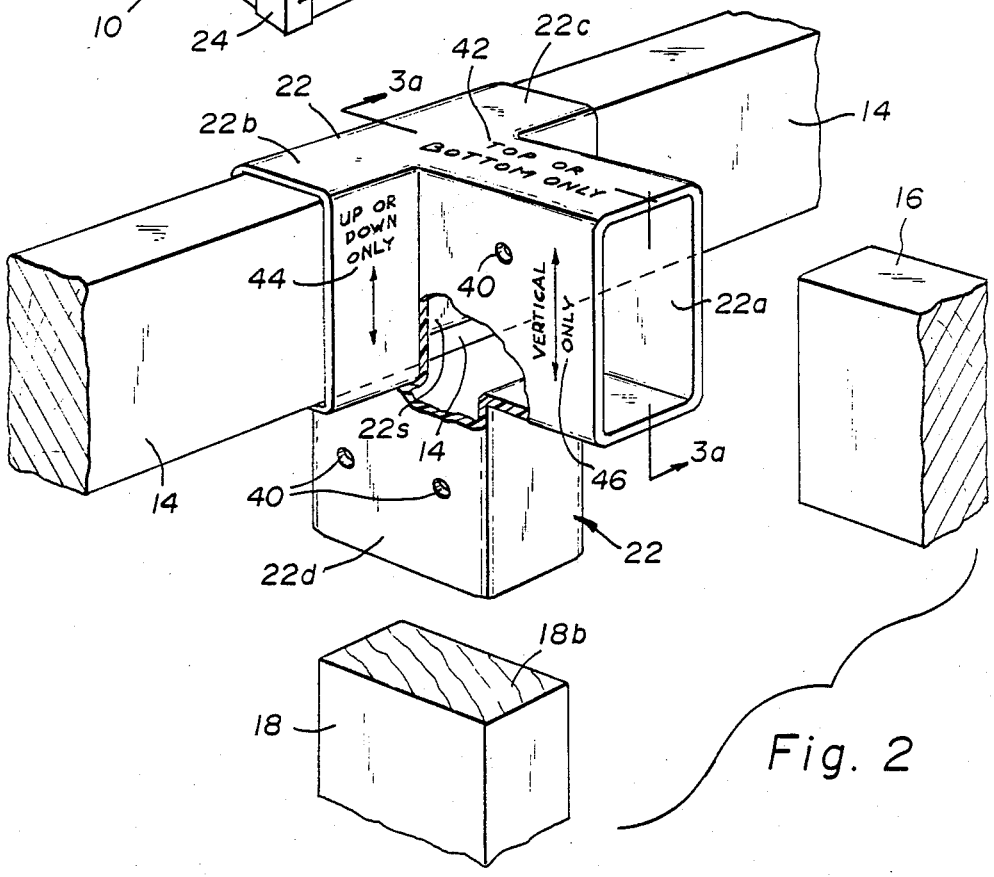
FIG. 2 is a perspective view, partly exploded, with parts broken away to show interior parts of one corner unit of FIG. 1 its associated two-by-fours.
Figure 3:
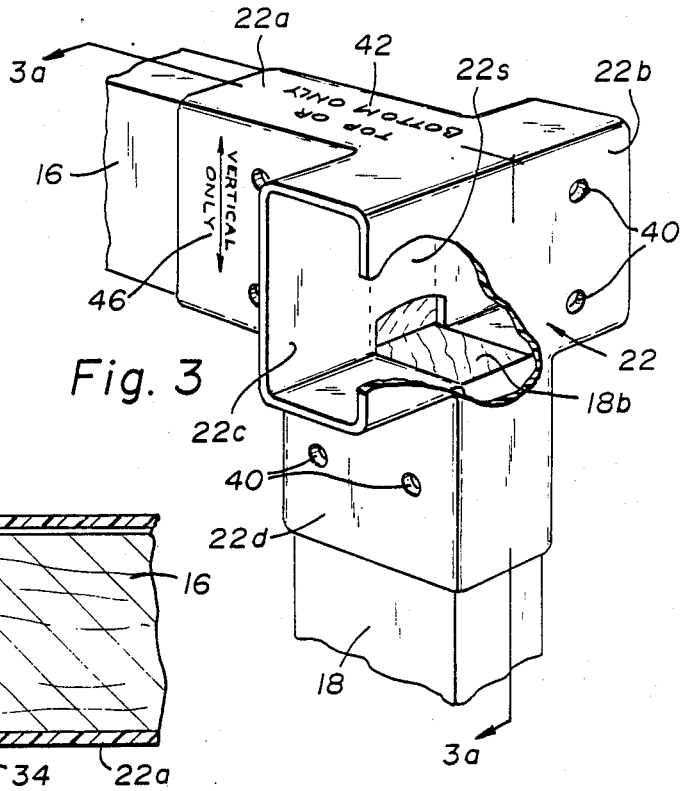
FIG. 3 is a perspective view of the member of FIG. 2 with one of the two-by-fours removed and with parts broken away to show parts.

Referring to FIGS. 2 and 3, the corner unit 22 is shown in more detail and can be seen to include a first horizontal sleeve 22*a*, sized to receive in a loose fit a standard-sized horizontal lumber such as the two-by-four member 16, with its longer cross-sectional dimension vertical. The unit 22 also includes a horizontal sleeve 22*b* secured at right angles to the sleeve 22*a* and also a third horizontal sleeve 22C. These latter two sleeves, 22*b* and 22*c*, are aligned and opened to one another, so as to form a single sleeve to loosely receive horizontal timber such as timber 14 as shown in FIG. 2. A fourth sleeve 22*d* is also provided, oriented at a right angle to each of the other three sleeves and vertically aligned so as to receive a vertically-aligned timber such as the two-by-four 18. The vertical sleeve 22*d* opens at its innermost area into the sleeve 22*a* and the sleeves 22*b*, 22*c*.

Figure 3A:
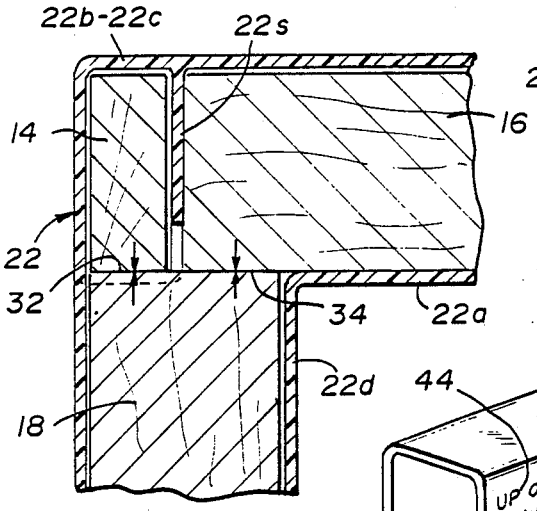
FIG. 3*a* is a sectional view of the unit of FIGS. 2 and 3 with its two-by-fours in place, as seen from the plane defined by the line 3*a*—3*a* in either of FIGS. 2 or 3.

The corner unit 22 is formed unitarily all of the same material and includes a timber-stop wall 22*s* between the sleeve 22*a* and the junction of the sleeves 22*b* and 22*c*; i.e., portion of the unit 22 that receives the two-by-four 14. The stop wall 22*s* does not extend over the entire base of the sleeve 22*a* but instead and in accordance with the present invention is set upward from the bottom of the sleeves as best seen in FIG. 3*a*.

This construction allows the horizontal timber 14 and 16 to make direct contact at surfaces 32, 34 (FIG. 3*a*), without any portion of the corner unit 22 interfering. That is, the vertical weight and forces (arrows in FIG. 3*a*) are directly transferred between the vertical lumber 18 and the horizontal lumber 14 and 16.

Note also that each horizontal two-by-four contacts approximately half of the butt end surface 18*b* of the vertical two-by-four 18.

The unit 22 is preferably made of machinable plastic such as polyethyline or polypropyline (with the latter being currently preferred). And the unit 22 is preferably provided with starter indentations 40 shown in FIGS. 2 and 3, so that nails may be conveniently driven through them and into the wood or else holes be drilled (using the starter indentations to start the drill bit) for pegs or bolts. Of course, if desired, pre-formed holes may be provided instead or in addition to such indentations 40.

Indicia such as that shown at 42 and 44 and 46 are provided to guide the user on the proper use of the corner units.

Figure 4:
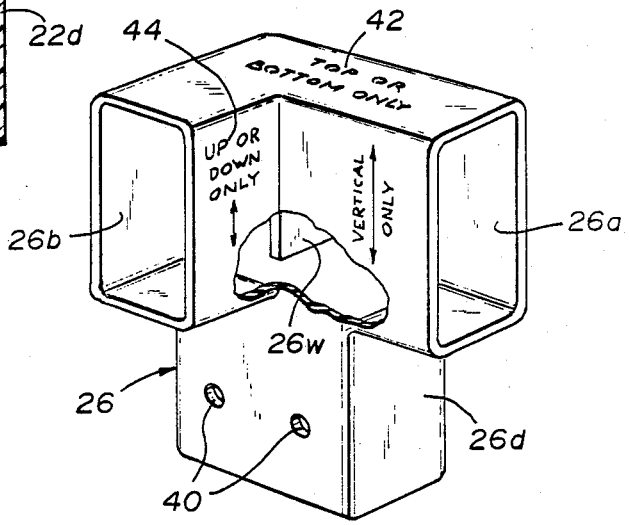
FIG. 4 is a perspective view of another corner member of FIG. 1 partly broken away to show interior construction and one interior part shown in dashed outline.

The same general principles for the construction of each of the other corner units 24, 26, and 28 are used. Referring to FIG. 4, the unit 26 is shown employing a stop wall 26W. This unit is designed for an outside corner and may be identical to the unit 22, except that the sleeve 22*c* is removed and preferably replaced by a wall. Thus, it has only two horizontal sleeves 26*a* and 26*b* and a vertical sleeve 26*d*. Again, it should be provided with the indicia 42, 44, and 46 and preferably also starter indentations 40.

Figure 5:
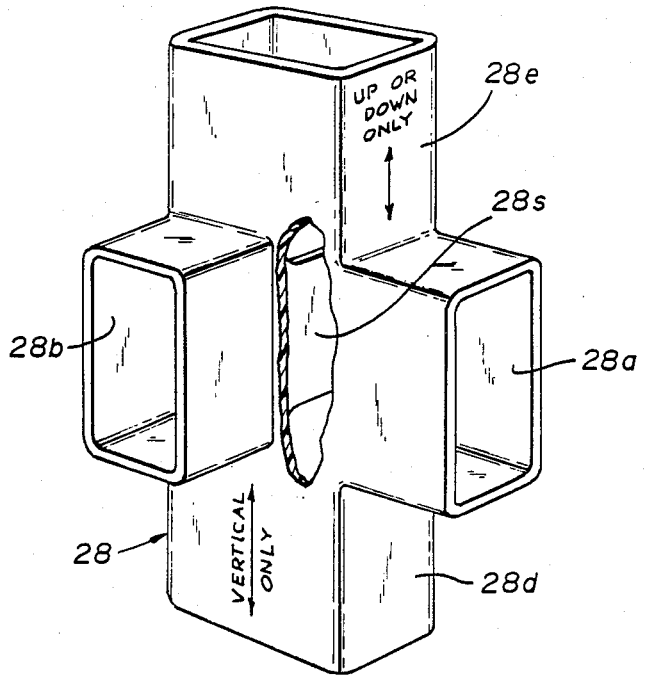
FIG. 5 is a perspective view of yet another corner unit or member, again partly broken away to show interior construction, constructed in accordance with the present invention, constructed of transparent materials.

FIG. 5 shows the corner unit 28 which may be constructed similarly to that of the unit 26 of FIG. 4 but with an added vertical sleeve 28*e*, in addition to its horizontal sleeves 28*a* and 28*b*, and its one vertical sleeve 28*d*. The wall 28*s* is offset from the plane of the top and bottom of the horizontal sleeves 28*a* and 28*b*, so as to require that the two-by-four placed therein must make direct wood-to-wood contact with the butt ends of the vertical two-by-fours positioned in the sleeves 28*d* and 28*c*.

While we have shown the stop members 22*s*, 26*s*, and 28*s* as walls, which is the currently preferred form of such stops, they can take other shapes and forms. The key point is not to interfere or contact the received vertical two-by-fours while serving as a stop for the two-by-four installed in the "a" horizontal sleeve (22*a*, 26*a*, 28*b*). Also, although the stops are preferred to prevent wrong insertion of the horizontal members, they are not absolutely necessary to practice the present invention, at least in its broader aspects.

A prototype of the invention has been constructed and tested, and it proved satisfactory. This wall constructed essentially as shown in FIGS. 2 and 3 out of polyethyline one-eighth inch thick, with a height of about 6-7/16 inches and overall width of about 4-½ inches and a depth of about 4-⅛ inches. The sleeves had an internal size of about 3-½ inches by 1-9/16 inches, so as to easily receive the standard two-by-four.

In constructing a framework such as that framework 10 shown in FIG. 1, the bottom two-by-fours 12 could be laid out and the arm corners 22 slid onto them. If desired, to secure them from longitudinal movement, a small nail could be driven through a horizontal wall into the two-by-four 12 when the corners are at the proper position. Cross members 16 could then be installed and nailed in place and corners 24, 26 attached at the ends of the bottom two-by-fours and the end cross member 16 secured. Thereafter, the vertical members 18 and 16 can be put in place, followed by the corner units atop each of them and the cross members between such corner units, plus the short vertical member 20 and the capping corner unit 24. Nailing and pinning or bolting in place of these units is preferably done after all of the pieces are assembled and seated in the sleeves.

Because the corner units 22, 24, 26, and 28 do not have to bear the vertical forces which are directly transferred to the wood, they need not be as strong as prior such steel corner joiners and can be as shown made out of cast-formed plastics, with a resulting savings in cost and ease of construction. (Although the flat bottom surface of the corners on the bottom of the structure will bear some weight, this is transferred directly to the floor or ground and does not create any shearing stress on the corner units.)

It should be apparent that a new and improved corner unit and framework made with such corner units have been described and depicted. The unit and the framework may be employed in many applications such as the building of demountable covers for boats and for furniture such as tables. For example, although shown with two-by-fours (the preferred application), the units can be easily adapted to receive other standard timber sizes, such as two-by-twos, two-by-sixes, and four-by-fours.

While several particular embodiments of the invention have been shown and described, it will be obvious to those skilled in the art that changes and modifications may be made without departing from the invention and, therefore, the aim in the appended claims is to cover all such changes and modifications as fall within the true spirit and scope of the invention.

I claim:

1. In combination, a connector member comprising a unitary body, said body including a first sleeve defining a vertically oriented opening, a first piece of lumber fitted in said first sleeve opening, said body further including a second sleeve defining a first horizontally oriented opening disposed at substantially a right angle to said first sleeve opening, a second piece of lumber fitted in said second sleeve opening, said body further including a third sleeve defining a second horizontally oriented opening disposed at substantially right angles to said second sleeve opening, a third piece of lumber fitted in said third sleeve opening, said body further including a wall part extending into said second sleeve opening adjacent said first and third sleeve openings, said wall part constituting means for preventing ingress of said second piece of lumber into either of said first or third sleeve opening, said first piece of lumber constituting means for supporting said second and third pieces of lumber in wood to wood contact when said pieces of lumber are fitted in their respective openings.

* * * * *